United States Patent [19]

Young et al.

[11] 4,438,430

[45] Mar. 20, 1984

[54] ALARM SYSTEM

[75] Inventors: Alfred G. Young, Joppa, Md.; Leon F. Slocomb, Jr., Wilmington, Del.; Francis V. Bugg, Towson, Md.

[73] Assignee: Acroseal Window Corporation, Annapolis, Md.

[21] Appl. No.: 299,069

[22] Filed: Sep. 3, 1981

[51] Int. Cl.[3] ..... G08B 13/08

[52] U.S. Cl. ..... 340/547; 200/61.62; 200/61.71; 200/61.93; 340/693

[58] Field of Search ..... 340/547, 693; 200/61.93, 61.62, 61.71

[56] References Cited

U.S. PATENT DOCUMENTS

| | | | |
|---|---|---|---|
| 700,812 | 5/1902 | Peyton | 340/547 |
| 873,935 | 12/1907 | Fawcett | 340/545 |
| 1,098,362 | 5/1914 | Nelson | 340/545 |
| 2,177,140 | 10/1939 | Jimenez | 43/59 |
| 2,191,926 | 2/1940 | Lemire | 340/545 |
| 2,437,777 | 3/1948 | Zajc | 340/545 |
| 2,877,361 | 3/1959 | Chase | 307/112 |
| 2,912,540 | 10/1959 | Sawicki | 340/547 |
| 2,924,682 | 2/1960 | Winterburn | 340/547 |
| 3,161,742 | 12/1964 | Bagno | 340/547 |
| 3,305,805 | 2/1967 | Tann | 335/153 |
| 3,410,245 | 10/1968 | Kashden | 340/547 |
| 3,426,166 | 2/1969 | Canceill | 200/61.62 |
| 3,470,554 | 9/1969 | Corbell | 340/547 |
| 3,596,021 | 7/1971 | Saul | 200/61.93 |
| 3,710,369 | 1/1973 | Takahashi | 340/547 |
| 3,742,479 | 6/1973 | Williams | 340/545 |
| 3,772,669 | 11/1973 | Johnston | 340/547 |
| 3,890,608 | 6/1975 | Peterson | 340/545 |
| 3,943,485 | 3/1976 | Waldman | 340/547 |
| 3,986,183 | 10/1976 | Fujiwara | 340/547 |
| 3,993,988 | 11/1976 | Walter | 340/547 |
| 4,160,972 | 7/1979 | LaMell | 340/541 |
| 4,258,359 | 3/1981 | McLamb | 340/546 |
| 4,335,375 | 6/1982 | Schaeffer | 340/547 |

*Primary Examiner*—Glen R. Swann, III

*Attorney, Agent, or Firm*—Connolly and Hutz

[57] ABSTRACT

An alarm system has its components completely concealed in the extruded framework of a window or door for actuation by a magnet mounted in a moving member with the alarm switch being a magnetically biased proximity sensor.

Latching means are provided for maintaining the switch contacts closed after being initially closed by the actuating member. The system may include a ferrous shield for insertion between the framework and window to disable the alarm system so that the window may be moved by authorized personnel.

11 Claims, 6 Drawing Figures

ALARM SYSTEM

BACKGROUND OF INVENTION

Various forms of alarm systems exist for detecting the unauthorized opening of a window or door. An ideal system would be one which the components thereof are concealed so that a burglar not only would be unaware of the existence of the alarm system but also because of the concealed nature would be unable to disarm the alarm. Such a system, however should have the capability of being conveniently disarmed so that the window or door can be opened by authorized personnel.

Various approaches have been taken by the prior art to provide suitable alarm systems. One such system is disclosed in Takahashi U.S. Pat. No. 3,710,369. In that patent utilization is made of extruded framework for concealing certain components of the alarm system. Unfortunately, however, not all of the components are concealed since apparently the power source and buzzer assembly are mounted externally of the extruded framework. The Takahashi patent also has serious drawbacks among others in that it would require complicated means for disabling the alarm system to permit a window or door to be opened by authorized personnel.

A further disclosure relating to concealing components of an alarm system is also found in Kashden U.S. Pat. No. 3,410,245.

SUMMARY OF INVENTION

An object of this invention is to provide an alarm system which overcomes the disadvantages of the prior art.

A specific object of this invention is to provide an alarm system generally of the type disclosed in the Takahashi patent but without the drawbacks thereof so that it represents an improvement and step forward from such art.

A further object of this invention is to provide a flexible alarm system which includes as an integrated system components concealed within the substantially hollow cores of nonmagnetic extruded cast or otherwise formed architectural fitting members of doors, windows and panels or the like.

In accordance with this invention a switch is mounted in the hollow framework of the architectural opening for actuation by a magnet in the closure member when the magnet is moved in proximity of the switch to thereby actuate alarm means also concealed within the hollow framework. Advantageously the switch is a magnetically biased proximity sensor such as a dry-reed switch that is magnetically biased by a permanent attachment of a magnet body.

In accordance with a preferred embodiment of this invention, disabling means are provided to permit the authorized opening without sounding the alarm. The disabling means may take the form of a ferrous shield which can be inserted between the framework and the closure member in the area of the sensor. Additionally the disabling means may take the form of a magnetic wand having a magnetic field stronger than that of the magnet or actuating member in the closure member for overriding the influence of the actuating member to maintain the sensor contacts open while the closure member is being moved.

In accordance with a further ramification of this invention, latching means may be associated with the sensor to maintain its contacts closed after being initially closed by the actuating member. The latching means may take the form of a latching magnet affixed to one of the leads of the sensor and having a field of strength insufficient to close the sensor contacts by itself but sufficiently strong to maintain them closed once having been closed by the actuating member.

The same alarm system may advantageously be used to sense and indicate predetermined conditions such as heat and fire detection as well as giving auxiliary indications of an unauthorized opening such as turning on lights or automatically dialing an emergency telephone number.

THE DRAWINGS

DETAILED DESCRIPTION

Figure 1:
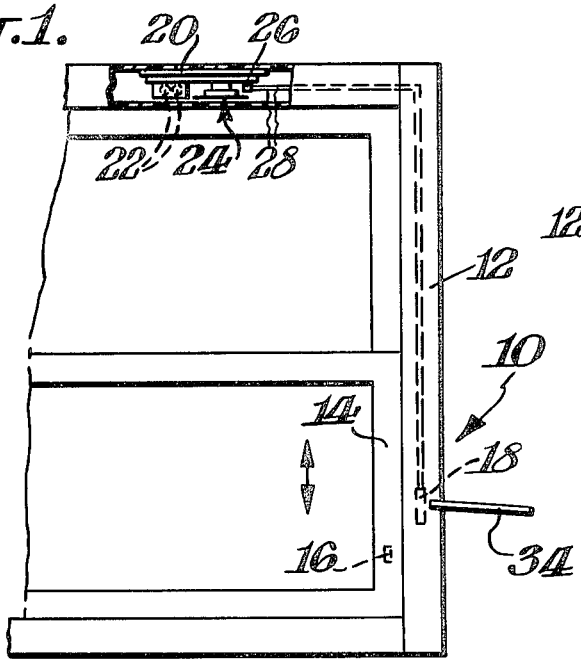
FIG. 1 is an elevation view partly in section of an alarm system in accordance with one embodiment of this invention for use with windows.

The present invention makes use of the fact that various architectural openings are framed by a hollow framework such as hollow cores resulting from extruded, cast or otherwise formed members on windows, doors or the like. FIG. 1, for example, shows the system 10 used as an alarm to detect the unauthorized opening of a window. As indicated therein, the architectural opening or window includes the hollow framework 12 which conceals all of the alarm system components except the actuating member or magnet which in turn is concealed within the framework of the movable sash 14.

Figure 4:
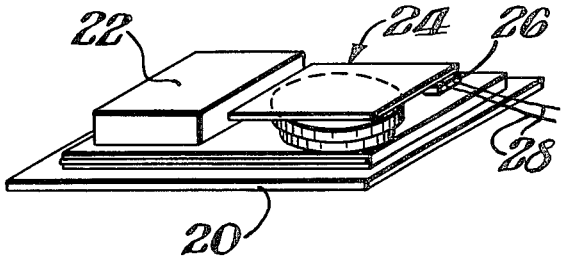
FIG. 4 is a perspective view of other portions of the alarm system shown in FIGS. 1–2.

In general alarm system 10 includes the magentic actuating member 16 concealed within the closure member in the general area of a fixed detector or sensor 18 which in turn is concealed within framework 12. The alarm system further includes a circuit board 20 shown in greater detail of FIG. 4 on which is mounted a power source 22 such as a suitable battery and the solid state alarm components generally indicated by the reference numeral 24 for giving an audio alarm. Components 24 also include a miniconnector 26 to which the electrical wires 28 are secured for connection to sensor 18. These alarm components may take any suitable form, and a detailed discussion thereof is accordingly not necessary.

An advantageous feature of alarm system 10 is that the various aforementioned components may be concealed within the hollow framework. Preferably, for example, circuit board 20 could be snapped in to the underside portion of framework 12 with the wires 18 extending across and down the framework as indicated so that detector 18 may be mounted near actuating member 16.

Figure 2:
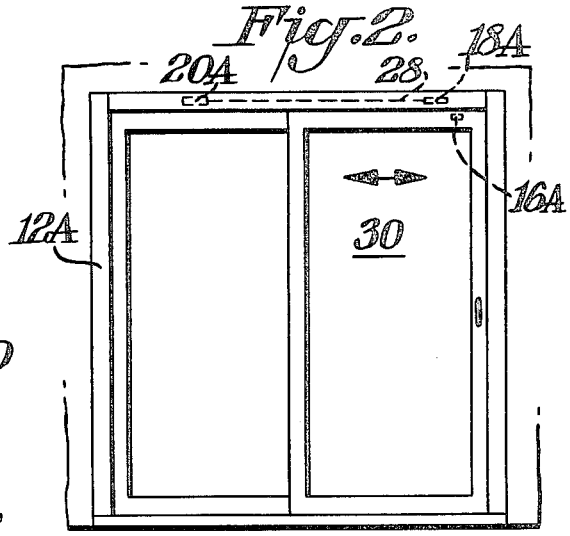
FIG. 2 is an elevation view of the alarm system of FIG. 1 but for use with doors.

As previously indicated the invention is not limited to any particular form of architectural opening. Thus, although FIG. 1 illustrates system 10 being used with a window, FIG. 2 illustrates its use with the alarm system concealed within framework 12A of a door wherein the closure member would be a sliding door 30 so that its actuating member 16A would be moved closer to sensor or detector 18A in the process of opening the door.

The following discussion will be had wherein the contacts of a switch of sensor 18 is closed to sound the alarm when the actuating member 16 moves closer to sensor 18. The invention, however, may likewise be practiced by actuating sensor 18 when the actuating member 16 is moved away from the sensor such as with the use of swinging windows or doors. Given this suggestion, one skilled in the art would readily know how to modify the switch and actuating members by movement of the actuating member away from the sensor.

In general the invention may take the form of one or more magnetically pre-biased reed-type switches responsive to a magnetic field and capable of performing in a differential manner according to the direction of movement of a magnet in proximity to and past it; i.e., responsively acting in only a momentary manner with a momentary electrical contact closure where the opening portion of the architectural closure is moving to a closed position and responsively acting in a permanent manner with a permanent electrical contact closure where the opening portion of the architectural fitting is moving to an open position. Such permanent contact closure may be negated only by a counter magnetic field as would be implemented by an authorized person.

In contrast to prior arrangements such as the Takahashi patent, the present invention provides such control function without the necessity of external, expensive and highly visible manual switches through the employment of separate aiding or bucking magnetic fields and/or magnetic shielding applied in a form and manner not requiring the mechanical penetration of the architectural member or the expensive, visible mounting and wiring of a manual switch.

Figure 3:
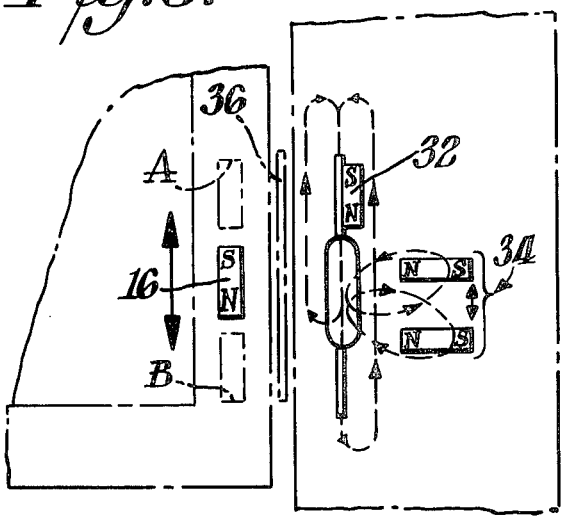
FIG. 3 is a schematic view of a portion of the alarm system shown in FIGS. 1–2.

The Takahashi patent discloses a general type reed switch as a means for actuating the alarm device. The present invention, however, uses a more specific type of switch and in particular a magnetically biased proximity sensor, for example but not limited to a dry-reed switch that is magnetically biased by a permenent attachment of a magnetic body. The switch of the present invention has the capability to perform differentially in the closure of its electrical contact according to the direction of passage of a magnet past it. Normally, a reed switch of the open contact variety employed in the present invention responds to the proximity of a magnet by the movement and closure of its electrical contact. As the magnet passes from proximity to the switch, its contacts re-open. Thus in the Takahashi patent and similar uses of the reed switch as an alarm component, expensive and complicated means such as relays and/or transistor circuitry (i.e., SCR components) or complicated multiple magnet or other mechanical means must be employed to maintain an ongoing alarm signal as may be initiated by the momentary reed switch contact closure as caused by the transient passage of a magnetic field. The present invention, however, obviates the necessity of expensive and complicated circuitry means by modifying a standard normally open contact reed switch by magnetically biasing it by permanently affixing a magnet 32 to one of the switch's leads. The bias is in itself of insufficient strength to close the contacts of the reed switch; however, once the contact has been closed with the aid of a secondary field in the form of another magnet, the contacts close and the bias field will hold the contacts closed even after the progression away of the secondary magnet. In this manner, the biased reed switch performs as a "latching" type switch without the need for expensive relays or semiconductors. In differentially responding to the field of the passing of a magnet such as that, for example, located within a movable sash of a window, as schematically shown in FIG. 3, it can be seen that when the magnet passes in its course from position A to position B relative to a stationary biased reed switch, the relative polarities run in order from aiding to bucking thereby only momentarily closing the reed switch contacts. Conversely, in the course of travel of the sash mounted magnet 16 from position B to position A (i.e., in opening of the sash) the relative polarities run in order from bucking to aiding, thereby "latching" in the reed switch contacts providing a locked-in electrical continuity.

A still further function of the detector or sensor 18 is that of a control switch for control of the circuit continuity characteristics in disarming the alarm signal as is presently accomplished by, for example, Takahashi in the use of an externally mounted manual switch and wiring interconnected with the alarm circuit. As shown in FIG. 3, a third magnetic field is introduced by a wand 34 comprising a magnet attached to an inert device which may be conveniently held in the hand. Bringing the wand 34 in approximation to the biased reed switch 18 located within the core of the architectural fromework will, depending on relative polarities, either buck or aid. In aiding the field, the biased reed switch contacts close, energizing the circuit and alarm signal for test purposes without moving the movable portion of the architectural fitting. In bucking the field with the wand 34, the magnetically biased reed switch contacts are opened disrupting electrical continuity to the alarm device and ceasing the alarm signal. In providing this interaction between a biased reed switch and a multiplicity of specific polarities of a magnetic field, the control function is obvious and the elimination of a manual switch and the required penetration of same through the wall of an architectural fitting has been accomplished. Similarly the magnet within the wand may be employed as a means of holding out the effect of the openable sash magnet 16 passing the biased reed switch in a case where it may be desired to open a sash without signalling the alarm. The wand 34 may be anchored in proximation to the reed switch by means allowing a temporary fixation, then removed at will. Alternatively, as shown in FIG. 3, a thin ferrous magnetic shield 36 may be inserted temporarily between the movable sash magnet 16 and the biased reed switch 18 to accomplish this same function. The present invention employing on magnetically biased reed switch as differentially responding devices and the performance of secondary control functions provides logic and action at minimal cost and complexity.

The present invention thus functions for signalling the opening of a movable architectural opening member in such a manner as to provide an alarm system which may be installed as a fully integrated system within the hollow cores of an architectural fitting without the expensive and difficult necessity of special extrusions, dies, drilling operations necessary to the routing of wires and mounting switches or other components exterior to the framework of such architectural fittings nor the substantial expense of switches, coils, relays, transistors, wheatstone bridges, etc., and their installation, interconnection and testing.

System 10 also avoids the necessity of circuit components such as transistors, coils, etc., of a like nature as a fully integrated system within the hollow cores of architectural opening members which may be decreased in like or or otherwise degraded by extreme temperatures and humidity conditions as may be encountered in the interior confines of such architectural opening members.

Figure 5:
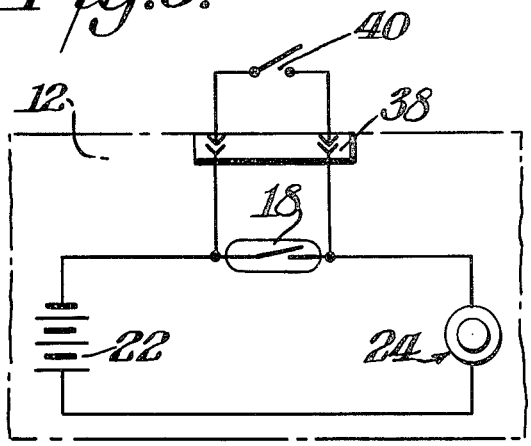
FIGS. 5–6 are schematic representations of circuitry used for alternative forms of this invention.

FIG. 5 represents a further aspect of this invention which makes use of the components and circuitry employed in alarm system 10 to monitor various environmental conditions. As indicated therein, provision is made on the building inside face of such architectural fitting for a miniature electrical pin jack 38 having terminals electrically connected in parallel with one leg of the interior of the framework wires that interconnects one side of the battery, biased reed switch and alarm signal device such that an externally mounted and auxilliary sensing device 40 with electrical contacts normally open but responding and closing upon a predetermined condition occuring may be plugged into such pin jack 38 in order that the same alarm signal components embodied within the architectural opening members may, in addition to their primary function as a burglar alarm, be alternatively used to also signal the same alarm for multiple conditions occuring, as an example, but not limited to, the closure of an electrical contact on elevated temperature conditions, humidity sensors, loss of building power devices, etc.

Figure 6:
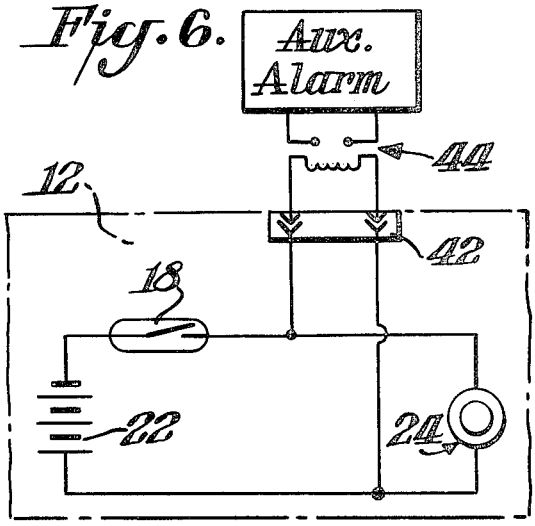

Still another aspect of the present invention is shown in FIG. 6. As illustrated therein, provision is made on the building inside face of such architectural fitting for a miniature pin jack 42 which terminals are electrically connected in parallel with two legs of the interior framework system wires so as to interconnect both sides of the battery, biased reed switch and alarm signal device such that an externally mounted signalling or relay device 44 capable of operation on the same electrical power level as provided by the battery power of the alarm device mounted within the architectural fitting framework may be plugged into the same pin jack and operate concurrently with the opening member alarm signal as previously described. This voltage appearing at the pin jack terminals concurrent with such appearing at and operating the internal framework mounted alarm signal can be used to operate, as an example, but in no way limited to, an external relay to switch higher power levels to initiate remote gongs, lights, automatic telephone dialing dialers, etc.

Although the invention has been described with particularity regarding various preferred embodiments thereof, it is to be understood that the invention may be practiced in other manners without departing from the spirit of the invention. For example, the framework which conceals the alarm system may be of any suitable material including but not limited to plastic, wood or metal. What is important is that, where the sensor is magnetically actuated, the framework should not interfere with such actuation.

Additionally although the invention has been described with respect to architectural openings such as windows or doors, the inventive system may be used for detecting any unauthorized movement of a closure member for any type of opening including but not limited to boat hatches and vehicle doors.

Further, while the invention has been described with respect to utilizing the hollow spaces that result from extruded framework, a main concept of the invention is that the system be concealed, and the manner of concealment is not necessarily limited to extruded frameworks. Thus, for example, the hollow framework can result from extruded, rolled or pultruded fiberglass materials and even from generally solid framework such as wood wherein hollow pockets have then been formed therein.

Still further the invention has been particularly described with respect to the actuating magnet being in the framework of the closure member and with the sensor being in the fixed framework around the opening. Again, however, the invention is not limited to such an arrangement but rather involves providing a fixed framework associated with the opening and providing a movable framework associated with the closure member. The fixed framework need not be the framework around the opening itself but can be with respect to any other fixed member and indeed need not be an actual framework. Thus the term framework is used in its broadest sense. In this regard, a window opening gradually includes a master frame, a screen insert and two glass inserts wherein one of the glass inserts is frequently fixed and only the other is movable. Thus either the actuator or the sensor may be associated with the movable glass insert while the other of the actuator or sensor may be associated with any of the other fixed parts such as the other glass insert, the screen insert of the master frame.

As can be appreciated, device 10 thus represents a marked improvement over the state of the art in providing an effective concealed alarm system which nevertheless may be conveniently disarmed and may also be utilized for accomplishing functions other than the primary burglar alarm.

What is claimed is:

1. In an alarm system for detecting the unauthorized movement of a closure member which selectively opens and closes an opening wherein a fixed framework is associated with said opening and a movable framework is associated with said closure member and wherein at least a portion of each of said fixed framework and said movable framework is hollow, said alarm system including a switch mounted in one of said frameworks, a magnetic actuating member mounted in said hollow portion of the other of said frameworks for actuating said switch in accordance with the proximity of said actuating member to said switch, and alarm means electrically connected to said switch for actuation thereby upon actuation of said switch, the improvement being said switch and said alarm means being completely concealed within its said hollow framework, said switch being a magnetically biased proximity sensor, said switch having contacts, and including latching means for maintaining said switch contacts closed after being initially closed by said actuating member.

2. The system of claim 1 wherein said switch is a dry-reed switch magnetically biased by the permanent attachment of a magnet body.

3. The system of claim 1 wherein said switch is actuated by the movement of said actuating member toward said switch, and further comprising disabling means for selectively disabling said alarm means whereby said actuating member may then be moved toward said switch without causing any actuation thereof so that the opening can be opened by authorized personnel.

4. The system of claim 3 wherein said disabling means comprising a magnetic wand having a magnetic field stronger than that of said actuating member for overriding the influence of said actuating member and thereby maintaining said switch unactuated.

5. The system of claim 1 wherein said latching means comprises a latching magnet affixed to one of the leads of said switch, said latching magnet having a field of a strength insufficient to close said switch contacts but sufficient to maintain said contacts closed after being closed by said actuating member.

6. The system of claim 1 including auxiliary sensing means for actuating said alarm means in response to the occurrence of a predetermined condition.

7. The system of claim 6 wherein said auxiliary sensing means comprises a pin jack electrically connected to the circuitry of said alarm means, and an external sensor connected to said pin jack for actuation upon sensing said predetermined condition.

8. The system of claim 7 wherein said predetermined condition is heat.

9. The system of claim 1 including auxiliary indicating means for giving an auxiliary indication of unauthorized opening of said closure member.

10. The system of claim 9 wherein said auxiliary indicating means comprises a pin jack connected of the circuitry of said alarm means, and an external relay coil connected to said pin jack for operating an auxiliary alarm.

11. In an alarm system for detecting the unauthorized movement of a closure member which selectively opens and closes an opening wherein a fixed framework is associated with said opening and a movable framework is associated with said closure member and wherein at least a portion of each of said fixed framework and said movable framework is hollow, said alarm system including a switch mounted in one of said frameworks, a magnetic actuating member mounted in said hollow portion of the other of said frameworks for actuating said switch in accordance with the proximity of said acutating member to said switch, and alarm means electrically connected to said switch for actuation thereby upon actuation of said switch, the improvement being said switch and said alarm means being completely concealed within its said hollow framework, said switch being a magnetically biased proximity sensor, said disabling means comprising a ferrous shield for insertion between said fixed framework and said closure member in the area of said switch to insulate said switch from being actuated by said actuating member.

* * * * *